US005519907A

United States Patent [19]

Poths

[11] Patent Number: 5,519,907

[45] Date of Patent: May 28, 1996

[54] DEVICE FOR RELAXING THE SKELETAL MUSCLE SYSTEM, IN PARTICULAR FOR THE NECK AND LUMBAR VERTEBRAE

[76] Inventor: Horst Poths, Kreisstrasse 4, 55437 Nieder-Hilbersheim, Germany

[21] Appl. No.: 281,932

[22] Filed: Jul. 28, 1994

[30] Foreign Application Priority Data

Jan. 29, 1992 [DE] Germany ..... 42 02 313.0
Jun. 11, 1992 [DE] Germany ..... 42 18 989.6

[51] Int. Cl.[6] ..... A47C 20/02

[52] U.S. Cl. ..... 5/636; 5/481; 5/901

[58] Field of Search ..... 5/481, 636, 901

[56] References Cited

U.S. PATENT DOCUMENTS

| | | | |
|---|---|---|---|
| 2,768,924 | 10/1956 | Wright | 5/481 |
| 3,222,697 | 12/1965 | Scheermesser | 5/481 |
| 3,222,698 | 12/1965 | Levenson | 5/481 |
| 3,753,264 | 8/1973 | Grenier | 5/636 |
| 4,110,881 | 9/1978 | Thompson | 5/481 |
| 4,383,342 | 5/1983 | Forster | 5/481 |
| 4,967,433 | 11/1990 | Neal | 5/481 |
| 5,048,136 | 9/1991 | Popitz | 5/636 |
| 5,153,956 | 10/1992 | Nold | 5/481 |
| 5,211,697 | 5/1993 | Kienlein | 297/453 |

*Primary Examiner*—Michael J. Milano
*Attorney, Agent, or Firm*—Horst M. Kasper

[57] ABSTRACT

A device for relieving the skeletal muscles, especially for the neck and lumbar vertebrae, comprises a mat of foam material with transverse ribs projecting on the upper side and most of the ribs standing obliquely towards the foot side and a foam pillow with transverse ribs projecting on the upper side and most of the ribs standing obliquely towards the head side. The divergently oblique transverse ribs of both foam sections stretch the spine in two opposite directions and increase the space between the vertebrae to release and soothe pinched nerve ends and overstressed disks.

12 Claims, 7 Drawing Sheets

DEVICE FOR RELAXING THE SKELETAL MUSCLE SYSTEM, IN PARTICULAR FOR THE NECK AND LUMBAR VERTEBRAE

CROSS-REFERENCE TO RELATED APPLICATIONS

This application is a continuation-in-part application of another international application filed under the Patent Cooperation Treaty on Jan. 26, 1993 and bearing Application No.: PCT/DE93/00060, and listing the United States as a designated and/or elected country. The entire disclosure of this latter application, including the drawings thereof, is hereby incorporated in this application as if fully set forth herein.

BACKGROUND OF THE INVENTION

1. Field of the Invention

The present invention relates to a device for relaxing the skeletal musculature, in particular the neck vertebrae, made of foam-material molded bodies with transverse ribs.

2. Brief Description of the Background of the Invention Including Prior Art

Many people suffer from pain and tensions resulting from pinched nerve ends in the spinal column and between the neck vertebrae. One cause of such pains resides in the use of unsuitable head cushions which do not take into account adequately the physiological characteristics of the human muscle system and of the skeleton.

From the German Printed Patent document DE 34 40 585 A1, a two-part apparatus for the extension of the vertebrae column is known, where this apparatus is comprised of a multiply-folded stretchable and expanding molded body and a springy support molded body. This two-part apparatus in the form of a special mattress has the object to act onto the entire vertebral column and is comprised of transverse ribs, where the transverse ribs are disposed raised and projecting upwardly between cover plates and where the transverse ribs are deformed when subjected to load. The entire mattress is composed of, for example, foam materials.

A body-contour conforming cushion for counteracting arthrosis of the neck vertebrae, described by way of example in the German Printed Patent document DBGM 90 16 604, has the disadvantage that it is composed of a comparatively nondeformable material, which is covered with a soft, porous material and which exhibits on its upper side a profiling corresponding to the curvature in the back of the neck. This configuration effects merely an improved support of the bent neck vertebrae column of a person sleeping in the dorsal position and this configuration of the pillow is inadequate because such person does not always remain in the dorsal position whilst sleeping. Etiologically speaking, it is neither the object nor the result of the cushion of the German Printed Patent document DBGM 90 16 604 to provide for a pre-existing arthrosis of the neck vertebrae.

SUMMARY OF THE INVENTION

1. Purposes of the Invention

It is an object of the present invention to simplify technically the manufacture of such an apparatus and to reconstruct it such that additional extension forces act onto the spaces between the vertebrae, where such extension forces cannot be exercised by a normally constructed head cushion.

These and other objects and advantages of the present invention will become evident from the description which follows.

2. Brief Description of the Invention

The present invention provides for a device for relaxing the skeletal musculature, in particular the neck vertebrae, made of foam-material molded bodies with transverse ribs. A first plate-shaped body having a flat side is disposed substantially horizontally. A plurality of upwardly diverging inclined ribs project from the flat side of the first plate-shaped body. The ribs are disposed transverse relative to the first plate-shaped body. The ribs have a length of at least about 5 centimeters. The first plate-shaped body and the inclined ribs are molded of a homogeneously distributed foam-material into a foam-material molded body such that a head rest is provided with the head and neck of a person disposed on the side of the device where the inclined ribs are diverged.

A folded-over extension of the first plate-shaped body can cover part of the inclined ribs at free ends of the upper side of the inclined ribs. A mattress having at least length corresponding to the length of a human body and having diverging inclined transverse ribs can be placed under the foam-material molded body.

A raised transverse rib can be disposed on the mattress. Preferably, a transverse groove is disposed on a bottom side of the foam-material molded body. The mattress can engage the transverse groove on the bottom side of the foam-material molded body with the raised transverse rib. Preferably, the thickness of the mattress decreases toward an end of the mattress corresponding to a foot position.

The foam-material molded body and the mattress can be made of latex foam material.

The foam-material molded body and the mattress are formed in one piece.

A support plate of substantially equal flat extension as the first plate-shaped body can be furnished for supporting the first plate-shaped body. The support plate can be made of the same homogeneously distributed foam material.

The substantially horizontally disposed first plate-shaped body can be a cover plate. Preferably, a plurality of upwardly diverging inclined ribs are projecting from a lower side of the cover plate by a length of at least about 5 centimeters.

The substantially horizontally disposed first plate-shaped body can be a bottom plate. Preferably, a plurality of upwardly diverging inclined ribs are projecting from an upper side of the bottom plate by a length of at least about 5 centimeters.

A cover plate can be attached to the upper ends of the ribs thereby forming a homogeneous foam-material molded body for the head and shoulder region with a bottom plate and a cover plate and with the ribs disposed extending between the bottom plate and the cover plate.

The first plate-shaped body can be a bottom plate. Preferably, the plurality of upwardly diverging inclined ribs are projecting from an upper side of the bottom plate by a length of from about 10 to 15 centimeters.

The novel features which are considered as characteristic for the invention are set forth in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

In the accompanying drawings, in which are shown several of the various possible embodiments of the present invention.

DESCRIPTION OF INVENTION AND PREFERRED EMBODIMENT

Figure 1:
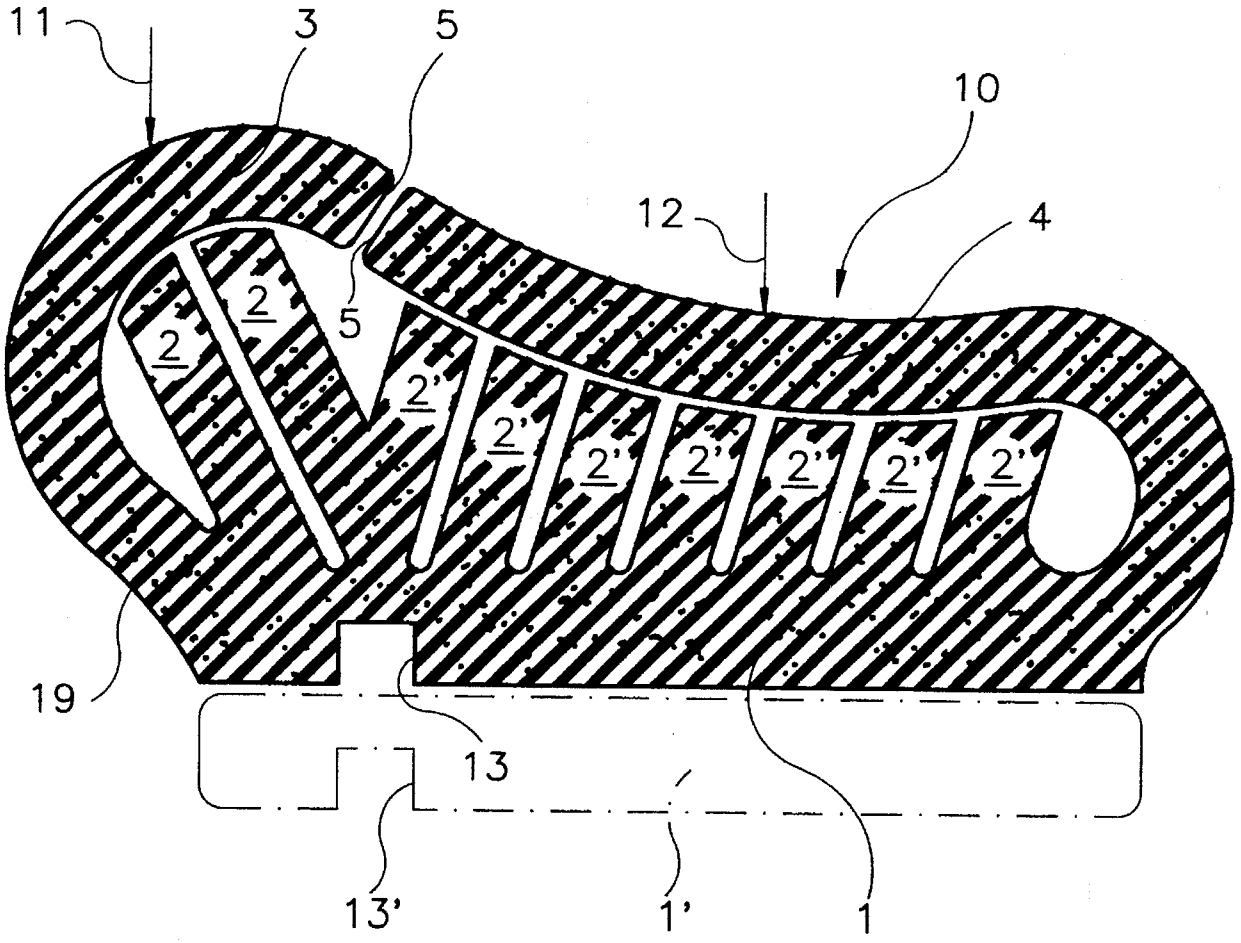
FIG. 1 is a sectional longitudinal view of a molded body made of foam on a reduced scale without covering.

According to the present invention there is provided a device for relaxing the skeletal musculature, in particular the neck vertebrae, made of foam-material molded bodies with transverse ribs. A homogeneous foam-material molded body 10 is provided for the head and shoulder area. The foam-material molded body 10 comprises an at least finger-thick bottom plate 1. A plurality of diverging inclined transverse ribs 2, 2' are projecting from the upper side of the bottom plate 1 by about the width of a hand. One or two folded-over bottom-plate extensions 3, 4 are covering the upper side of the transverse ribs 2, 2'. An at least body-length mattress 15 having diverging inclined transverse ribs 16, 16' is placed under the foam-material molded body 10 or, respectively 10 and 1'.

The bottom plate 1 can be supported on an equally sized support plate 1' made of the same homogeneous foam material.

A mattress 15 can engage with a raised transverse rib 14 into a transverse groove 13 on the underside of the foam-material molded body 10. Preferably, the thickness of the mattress 15 decreases toward the foot end.

The foam-material molded body 10 and the mattress 15 can be made of latex foam material.

A homogeneous foam-material molded body 101 can be provided for the head and shoulder region, where the molded body 10 consists of an at least finger-thick cover plate 21. Preferably, a plurality of diverging inclined transverse ribs 2, 2' are projecting from the under side of the cover plate 21 by about the width of a hand.

A homogeneous foam-material molded body 102 can be provided for the head and shoulder region, where the molded body 102 consists of an at least finger-thick bottom plate 1 and an at least finger-thick cover plate 21. A plurality of possibly diverging inclined transverse ribs 2, 2' can be disposed between the bottom plate 1 and the cover plate 21.

An at least body-length mattress can be provided, where the mattress is covered by a cover plate.

The foam-material molded body 10; 101; 102; 103 and/or the body-length mattress 15 can exhibit a center plate instead of a bottom plate or, respectively, a cover plate.

Preferably, the foam-material molded body 10; 101; 102; 103 and the body-length mattress 15 are formed in one piece.

A homogeneous foam-material molded body 103 can be provided for the head and shoulder region, where the foam-material molded body 103 comprises an at least finger-thick bottom plate 1. Preferably, a plurality of diverging inclined transverse ribs 2, 2' are projecting from the upper side of the bottom plate 1 by about the width of a hand.

Exemplified embodiments of the invention are explained in the following with reference to the drawing.

In case of particularly broad-shouldered people, it is recommended to support the bottom plate on an identically sized support plate made of the same homogeneous foam material.

If the foam-material molded body is supported by a mattress, of at least body length and having diverging inclined transverse ribs on its upper side, there can be achieved an extension effect acting on the entire vertebrae column.

The foam-material molded body 10, illustrated in FIG. 1, comprises an at least finger-thick bottom plate 1, where a plurality of diverging inclined transverse ribs 2, 2' project upwardly by about a hand's width from the upper side of the bottom plate 1. The thickness of bottom plate can be from about 1 to 5 centimeters and is preferably from about 2 to 3 centimeters. The inclination angle of the ribs can be from about 40 to 80 degrees and is preferably from about 60 to 75 degrees relative to a horizontal line. The length of the ribs can be from about 5 to 30 centimeters and is preferably from about 10 to 20 centimeters. The inclination angle of the ribs is disposed such that the ribs point with their free ends toward the upper end of the person in the section corresponding to the upper part of the head and such that the ribs point with their free ends toward the lower end of the person in the section corresponding to neck and shoulders.

The ribs 2, 2' extend substantially upwardly from the bottom plate for allowing the upper section of a person with the head to be supported through the free ends of the transverse ribs.

The bottom plate 1 includes one or two extensions 3, 4, which are folded over upwardly and cover the transverse ribs 2, 2'. The extensions 3, 4 are to be interposed between the free ends of the ribs 2, 2' and the person and his or her head to be resting. The thickness of the extensions can be less than the thickness of the bottom plate and is preferably from about 1 to 2 centimeters. The extensions are disposed such that the head of a person comes to rest against the upper face of the extensions 3 and 4. In the case of two bottom plate extensions 3, 4, the two counter-directed front faces of the ends of the extensions 3 and 4 are facing each other and form an open gap 5.

The load pressure onto the extensions 3, 4 exercised by the human neck is indicated by the arrow 11 and the load pressure exercised by the head is indicated by the arrow 12.

The shoulder of the sleeping person is adequately accommodated in the depression 19 of the foam-material molded body 10 while the head of the person is in a sideways position and, in case of particularly broad-shouldered persons, it is recommended to place an additional bottom plate 1' under the foam-material molded body 10.

Figure 2:
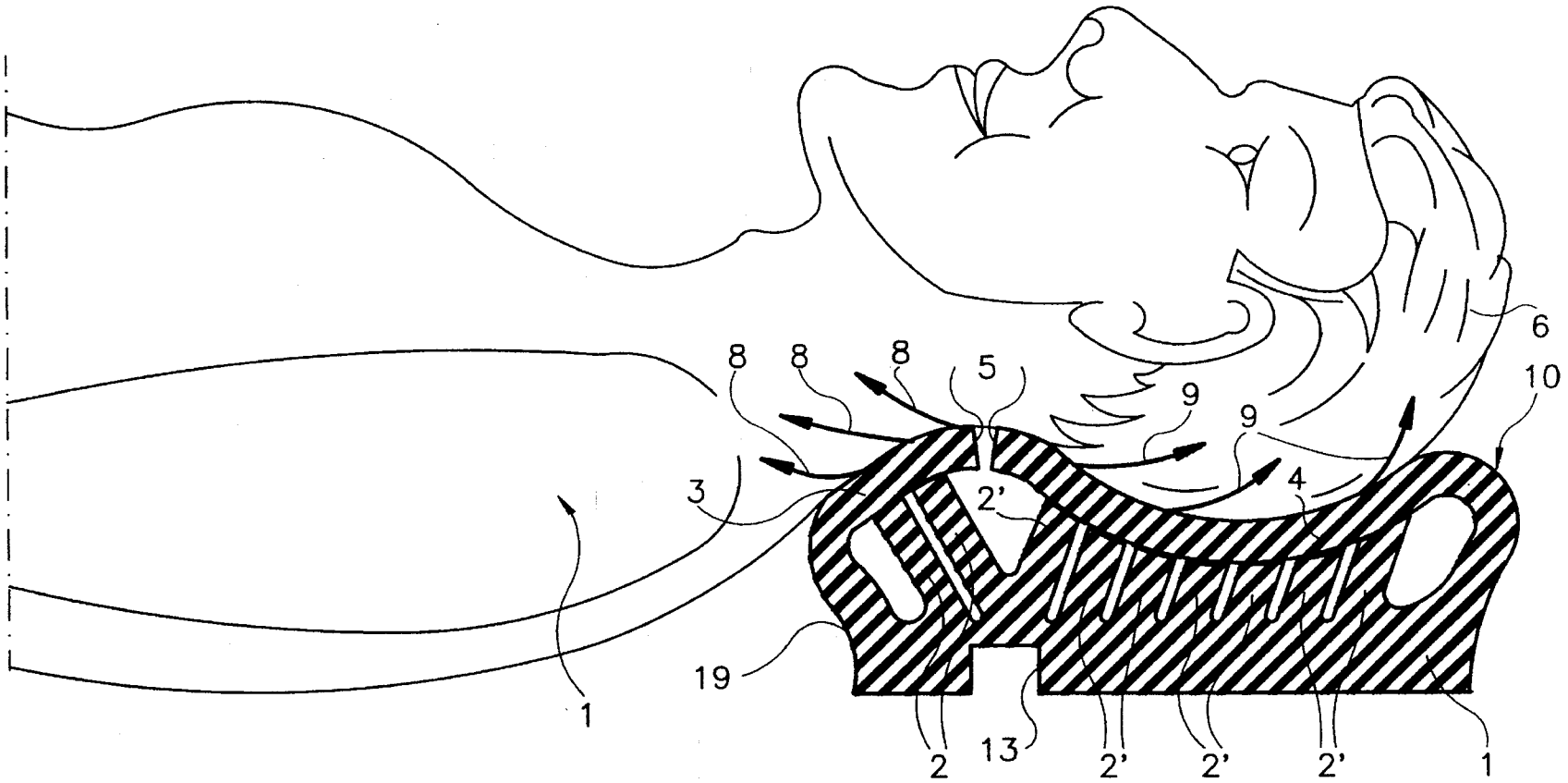
FIG. 2 is a side view of the object of FIG. 1 subjected to load of the sleeping person.

The loading situation illustrated in FIG. 2 shows that the transverse ribs 2 and 2' are shortened based on compression, thereby exercising divergent pressure effects in direction of the arrows 8 and 9, which result in an extension of the neck vertebrae. Even slight extensions suffice to achieve a noticeable relaxation of pinched nerves. It is important that the head 6 and the shoulder 7 of the sleeping person is urged and spread apart in direction of the arrows 9 and 8.

Figure 3:
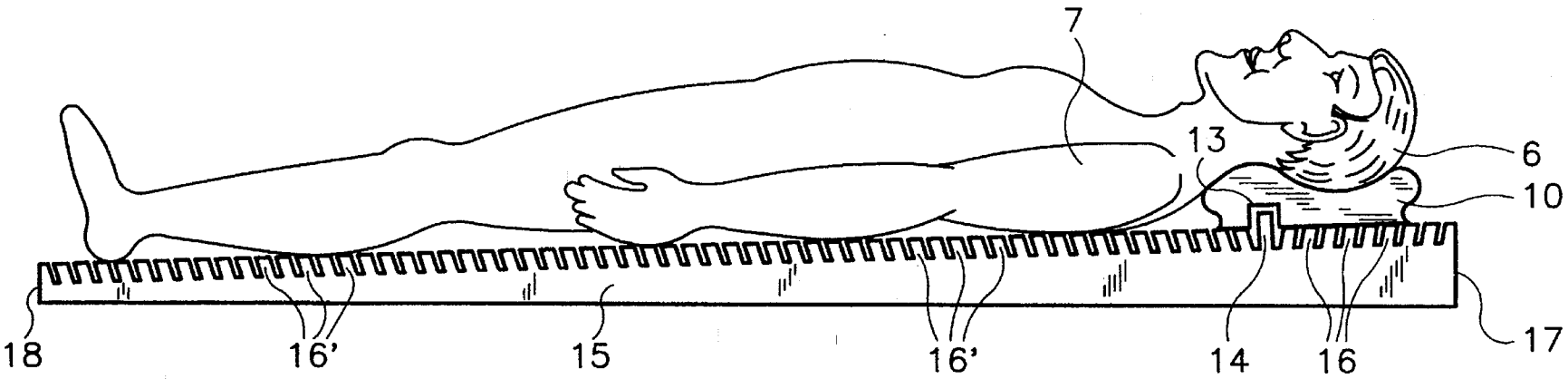
FIG. 3 is a side elevational view of the foam-material molded body and a supporting mattress on a highly reduced scale and subjected to load of the sleeping person.

The additional mattress 15 illustrated in FIG. 3, where the mattress 15 exhibits on its upper side also diverging transverse ribs 16 and 16', brings about an extension effect acting on the entire vertebral column.

The foam-material molded body 10 finds a secure, immovable hold on the mattress 14 in that a raised transverse rib 14 of the mattress 15 engages into a transverse groove 13 on the underside of the foam-material molded body 10.

An optimization of the extension effect acting on the entire vertebral column is achieved in that the head end 17 of the mattress 15 exhibits a larger thickness than the foot end 18 of the mattress 15.

The use of latex foam material is recommended for the foam material of the molded body.

A further exemplified embodiment of a foam-material molded body is described in the following with reference to the drawing in FIG. 4.

Figure 4:
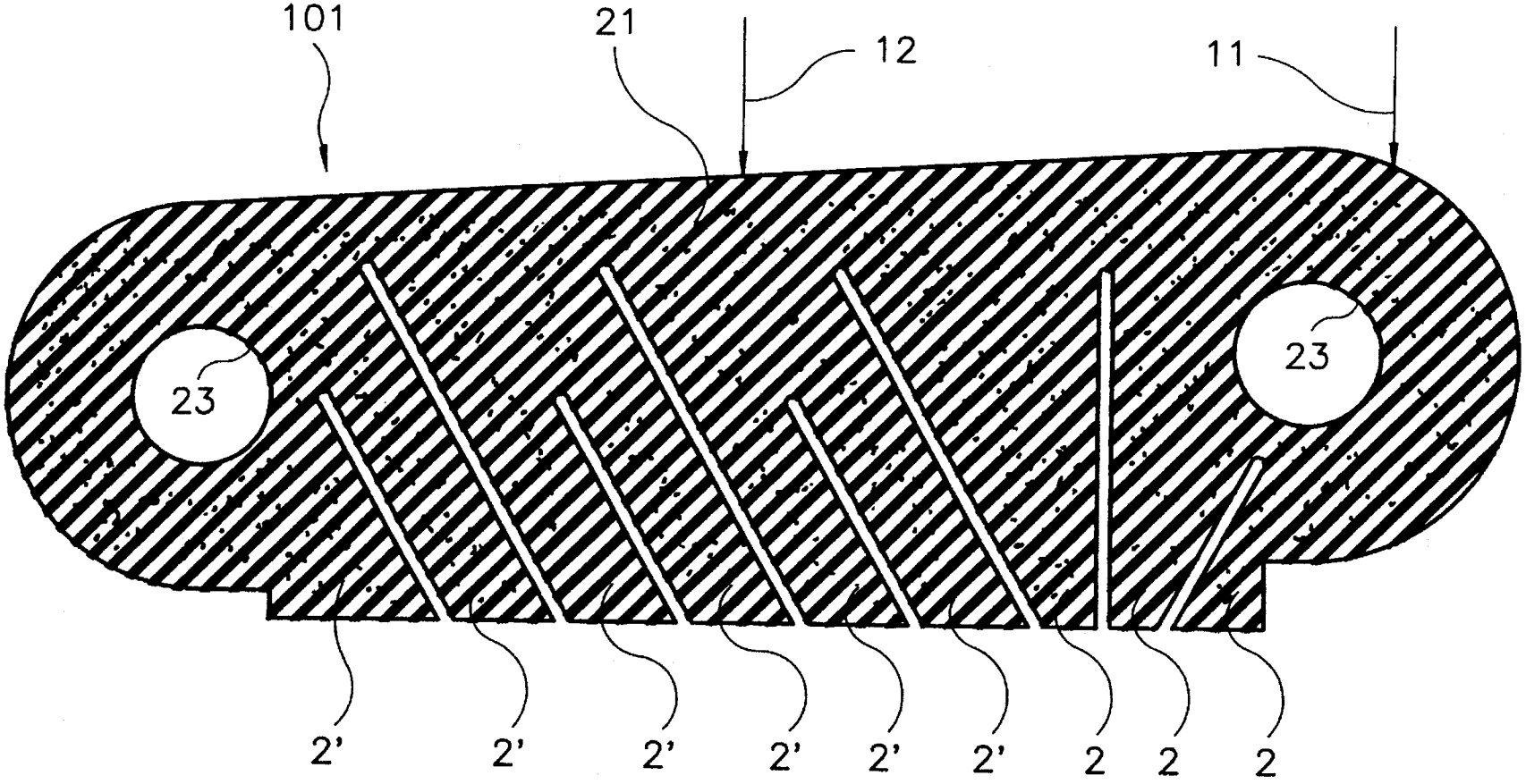
FIG. 4 is a side elevational view of a second embodiment of the foam-material molded body on a reduced scale without covering.

The foam-material molded body 101, illustrated in FIG. 4, comprises an at least finger-thick cover plate 21, where a plurality of possibly diverging inclined transverse ribs 2, 2' project by about a hand's width from the under side of the bottom plate 21. The length of the ribs 2, 2' can be from about 5 to 30 centimeters and is preferably from about 10 to 20 centimeters. The thickness of the cover plate 21 can be from about 1 to 5 centimeters and is preferably from about 2 to 3 centimeters. The inclination angle of the ribs 2, 2' can be from about 40 to 80 degrees and is preferably from about 60 to 75 degrees relative to a horizontal line. The inclination angle of the ribs is disposed such that the ribs point with their free ends toward the lower end of the person in the section corresponding to the upper part of the head and such that the ribs point with their free ends toward the upper end of the person in the section corresponding to where neck and shoulders come to rest.

The ribs can be formed in pairs such that a deep incision into the foam is provided between pairs of fingers and that the incision is not as deep between two ribs forming a pair. The depth of incision between pairs can be from about 1.2 to 2 times the depth of an incision between ribs forming a pair of ribs 2, 2'. The sections of the differing slots of incision are separated from each other by an deep incision in a direction substantially perpendicular to the plane of the cover plate 21.

The load pressure exercised by the neck is indicated by the arrow 11 and the load pressure exercised by the head is indicated by the arrow 12.

Figure 5:
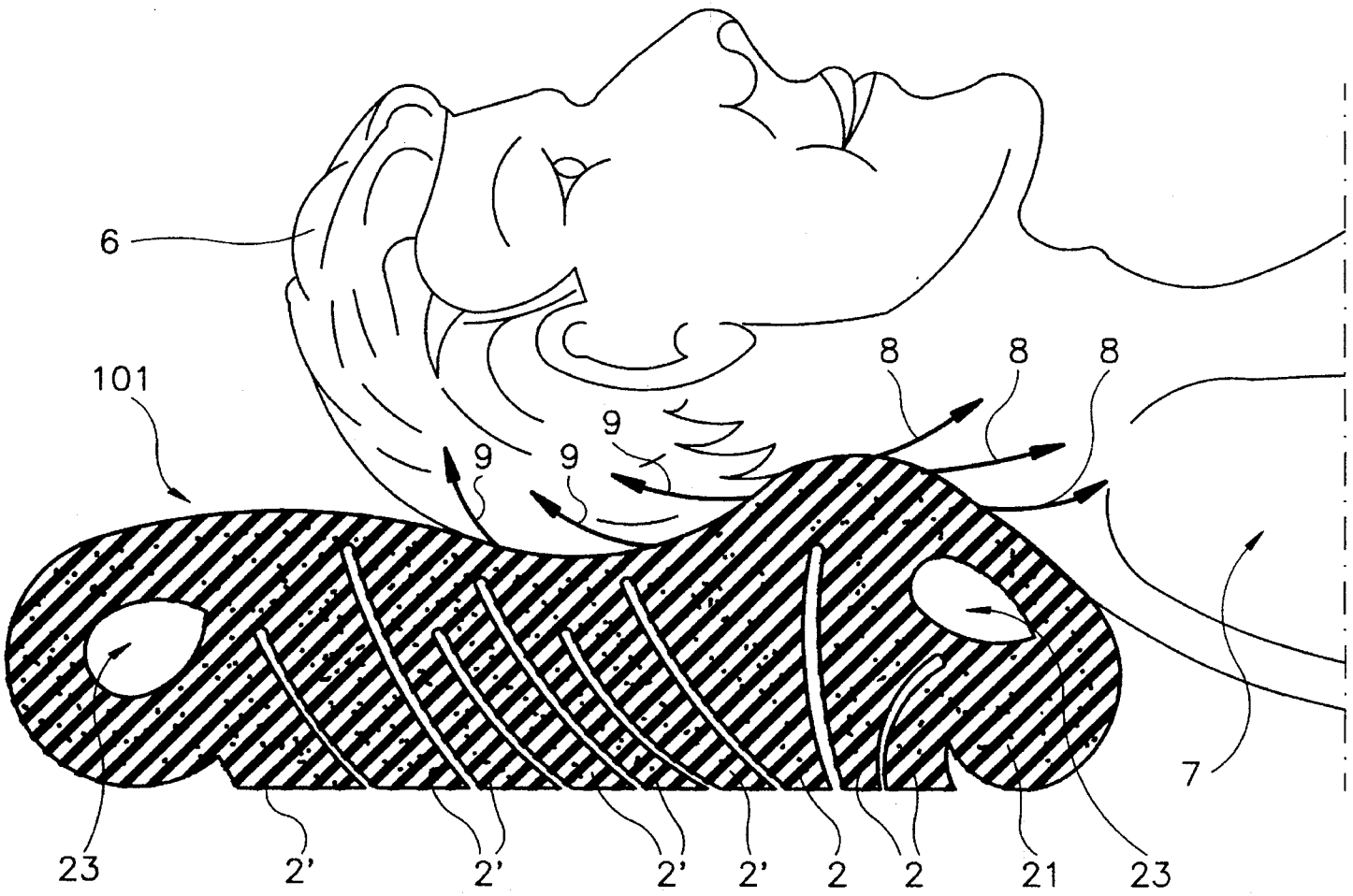
FIG. 5 is a side elevational view of the embodiment of FIG. 4 while subjected to load by the head of the sleeping person.

The loading situation illustrated in FIG. 5 shows that the transverse ribs 2 and 2' are shortened based on compression, thereby exercising divergent pressure effects in direction of the arrows 8 and 9, which result in an extension of the neck vertebrae. Even slight extensions, which however continue over a time period of several hours, suffice to achieve a noticeable relaxation of pinched nerves. What is of essence is that the head 6 and the shoulder 7 of the sleeping person is urged and spread apart in direction of the arrows 9 and 8.

For elasticity reasons, it is possible to provide transverse passages 23 of relatively large diameter at the head end of the foam-material molded body 101, where these transverse passages 23 ascertain an easy compression of these end parts of the foam-material molded body. The transverse passages are in a rest situation of the pillow empty spaces inside of the foam material used. The end sections of the pillow are preferably of a semi-circular shape and the transverse passages are of a cylindrical shape with the cylinder axis aligned and substantially coinciding with the center of the semi-circular shapes.

Figure 6:
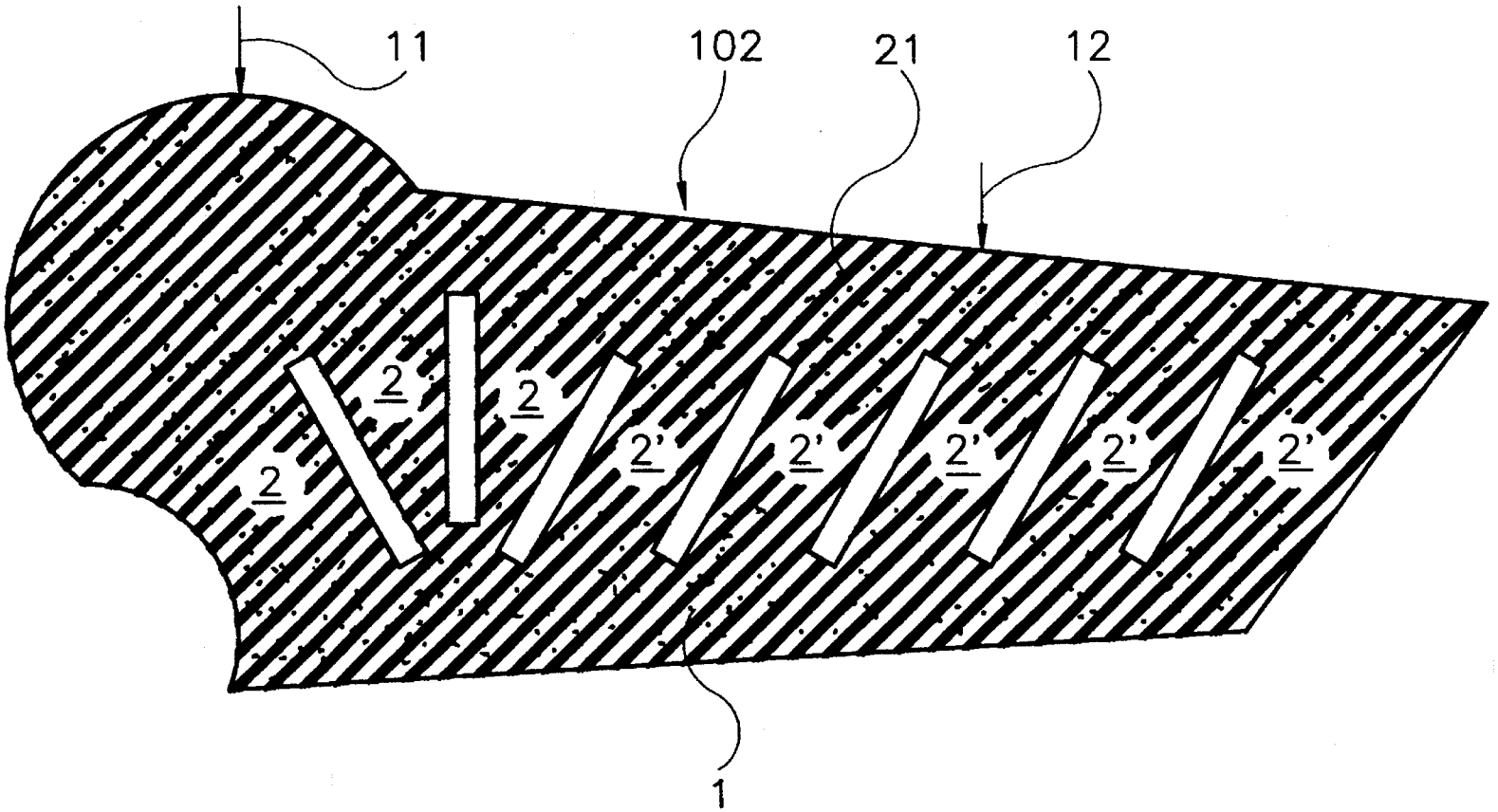
FIG. 6 shows a third embodiment of a foam-material molded body 102, where the transverse ribs 2 and 2' are disposed between a bottom plate 1 and a cover plate 21.

A third embodiment of the invention is shown in FIG. 6, where a foam-material molded body is formed to have transverse ribs 2 and 2', where the transverse ribs 2 and 2' are disposed between a bottom plate 1 and a cover plate 21. The embodiment of FIG. 6 includes both a bottom plate and a cover. The ribs are still provided, however now there are no free ends of the ribs, but the ribs end on one end side in the bottom plate 1 and the second end side in the in the cover 21. The thickness of the ribs can be less than the thickness of the bottom plate and is preferably from about 1 to 2 centimeters. The ribs 2, 2' are disposed such that the head of a person comes to rest against ribs directed upwardly as defined by the natural standing position of the person. The cover 21 can run at an angle of from about 5 to 20 degrees and preferably at an angle of from about 10 to 15 degrees relative to the bottom plate such that the distance of the cover plate from the bottom plate is larger in the neck region as compared to the end corresponding to the head rest position. The thickness of the cover plate 21 can be from about 1 to 5 centimeters and is preferably from about 2 to 3 centimeters.

The length of the ribs 2, 2' can be from about 5 to 30 centimeters and is preferably from about 10 to 20 centimeters. The inclination angle of the ribs 2, 2' can be from about 40 to 80 degrees and is preferably from about 50 to 70 degrees relative to a horizontal line. The inclination angle of the ribs is disposed such that the ribs are disposed like the petals of a flower directing away from each other when going upward, i.e. similar to a person resting its head on a blossom of a flower, and such that the ribs are directed radially outwardly relative to the person when viewed from a center disposed behind the neck of the person.

Figure 7:
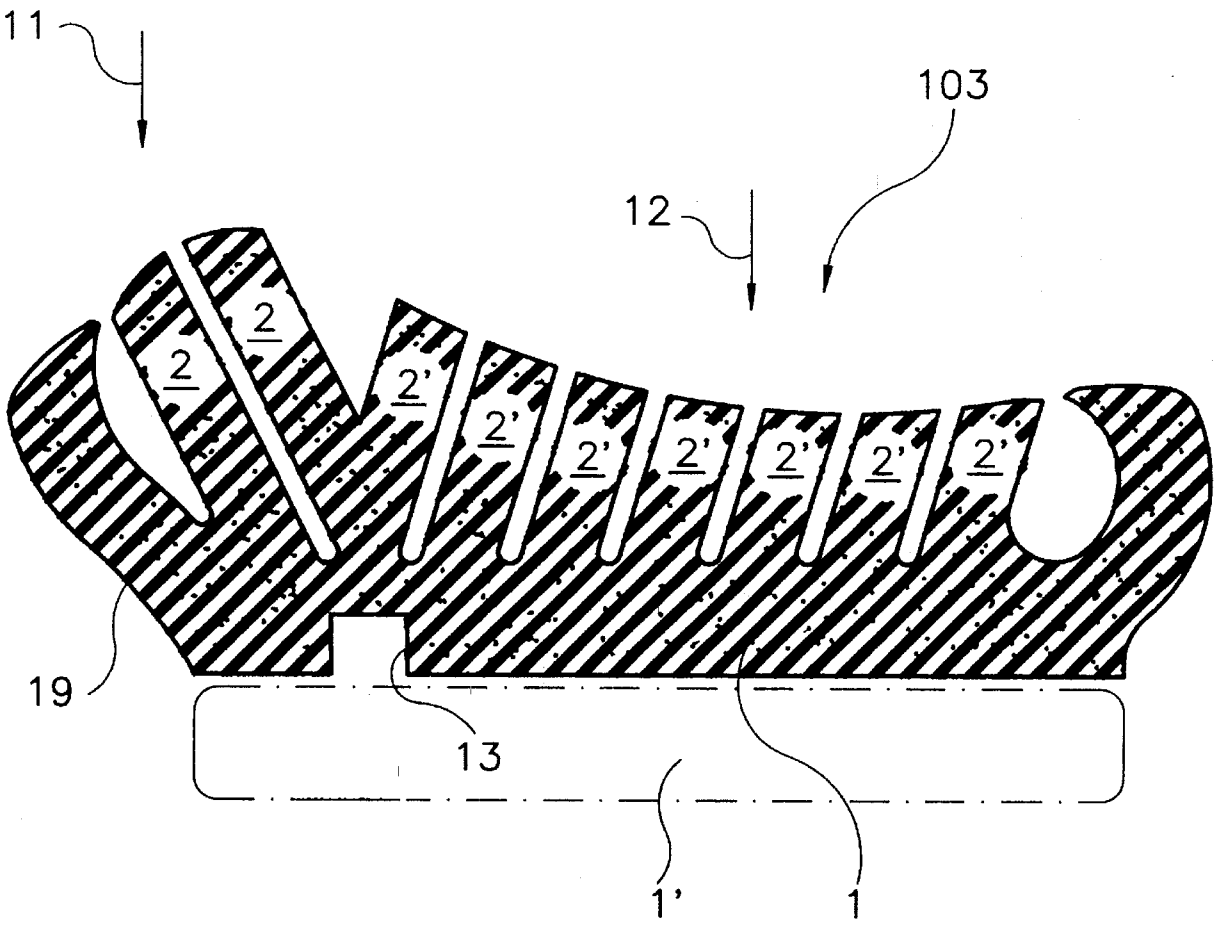
FIG. 7 shows a fourth embodiment of a foam-material molded body 103, where the transverse ribs 2 and 2' are not covered by foam material on their upper side but rather end freely.

A fourth embodiment of the invention is illustrated in FIG. 7 with a foam-material molded body 103, where transverse ribs 2 and 2' are not covered by foam material on their upper side, but where the transverse ribs 2, 2' have freely extending ends. FIG. 7 is a view of an embodiment similar to the embodiment of FIGS. 1 through 3, however without a presence of the extensions 3 and 4. The extensions 3 and 4 of FIG. 1 are present in a rudimentary way in FIG. 7, insofar as ribs are provided corresponding to the extensions, which however have a length substantially similar to the length of the other ribs also present according to FIG. 1. The dimensions of the embodiment of FIG. 7 substantially correspond to the dimensions which have been set forth above in connection with FIG. 1.

It will be understood that each of the elements described above, or two or more together, may also find a useful application in other types of devices for relaxing the skeletal muscle system differing from the types described above.

While the invention has been illustrated and described as embodied in the context of a storage tank for liquefied gases, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A device for relaxing the skeletal musculature and the neck vertebrae, comprising a substantially horizontally disposed first plate-shaped body having a flat side;

a plurality of upwardly diverging inclined ribs projecting from the flat side of the first plate-shaped body, and wherein the ribs are disposed transverse relative to the first plate-shaped body, and wherein the ribs have a length of at least about 5 centimeters, and wherein the first plate-shaped body and the inclined ribs are molded of a homogeneously distributed foam-material into a foam-material molded body such that a head rest is provided with the head and neck of a person disposed on the side of the device where the inclined ribs are diverged;

a folded-over extension of the first plate-shaped body for covering part of the inclined ribs at free ends of the upper side of the inclined ribs; and a mattress having at least a length corresponding to the length of a human body and having diverging inclined transverse ribs for being placed under the foam-material molded body.

2. The device according to claim 1 further comprising a raised transverse rib disposed on the mattress;

a transverse groove disposed on a bottom side of the foam-material molded body, wherein the mattress engages the transverse groove on the bottom side of the foam-material molded body with the raised transverse rib, and wherein the thickness of the mattress decreases toward an end of the mattress corresponding to a foot position.

3. The device according to claim 2 wherein the foam-material molded body and the mattress are made of latex foam material.

4. The device according to claim 1 further comprising a support plate of substantially equal flat extension as the first plate-shaped body for supporting the first plate-shaped body, and wherein the support plate is made of the same homogeneously distributed foam material.

5. The device according to claim 1 wherein the substantially horizontally disposed first plate-shaped body is a cover plate, and wherein a plurality of upwardly diverging inclined ribs are projecting from a lower side of the cover plate by a length of at least about 5 centimeters.

6. The device according to claim 1 wherein the substantially horizontally disposed first plate-shaped body is a bottom plate, and wherein a plurality of upwardly diverging inclined ribs are projecting from an upper side of the bottom plate by a length of at least about 5 centimeters.

7. The device according to claim 6 further comprising a cover plate attached to the upper ends of the ribs thereby forming a homogeneous foam-material molded body for the head and shoulder region with a bottom plate and a cover plate and with the ribs disposed extending between the bottom plate and the cover plate.

8. The device according to claim 1, wherein the first plate-shaped body is a bottom plate, and wherein the plurality of upwardly diverging inclined ribs are projecting from an upper side of the bottom plate by a length of from about 10 to 15 centimeters.

9. Device for relaxing the skeletal musculature and the neck vertebrae, made of foam-material molded bodies with transverse ribs, characterized in a homogeneous foam-material molded body (10) for the head and shoulder area, where the foam-material molded body (10) comprises a bottom plate (1), a plurality of diverging inclined transverse ribs (2, 2') projecting from the upper side of the bottom plate (1), and one or two folded-over bottom-plate extensions (3, 4), covering the upper side of the transverse ribs (2, 2'), wherein an at least body-length mattress (15) having diverging inclined transverse ribs (16, 16') is placed under the foam-material molded body (10 or, respectively 10 and 1').

10. Device according to claim 9, characterized in that the bottom plate (1) is supported on an equally sized support plate (1') made of the same homogeneous foam material.

11. Device according to claim 9, characterized in that the foam-material molded body (10) and the mattress (15) are made of latex foam material.

12. Device according to claim 9, characterized in that the foam-material molded body (10; 101; 102; 103) and the body-length mattress (15) exhibit a center plate instead of a bottom plate or, respectively, a cover plate.

* * * * *